US007404500B2

(12) United States Patent
Marteau et al.

(10) Patent No.: US 7,404,500 B2
(45) Date of Patent: Jul. 29, 2008

(54) PILL DISPENSING DEVICE

(75) Inventors: Dennis Marteau, Oxford (GB); Steven Mark Rolfe, Oxon (GB)

(73) Assignee: Owen Mumford Limited, Oxfordshire (GB)

( * ) Notice: Subject to any disclaimer, the term of this patent is extended or adjusted under 35 U.S.C. 154(b) by 194 days.

(21) Appl. No.: 10/554,392

(22) PCT Filed: May 13, 2004

(86) PCT No.: PCT/GB2004/002072

§ 371 (c)(1),
(2), (4) Date: Oct. 24, 2005

(87) PCT Pub. No.: WO2004/103856

PCT Pub. Date: Dec. 2, 2004

(65) Prior Publication Data

US 2006/0207996 A1 Sep. 21, 2006

(30) Foreign Application Priority Data

May 23, 2003 (GB) ..... 0311931.0

(51) Int. Cl.
*B65H 1/08* (2006.01)

(52) U.S. Cl. ..... 221/228; 221/208; 221/224; 221/225; 221/226; 221/227; 221/229; 221/247; 221/248; 221/154; 221/263; 221/264; 221/265

(58) Field of Classification Search ..... 221/1–312 C
See application file for complete search history.

(56) References Cited

U.S. PATENT DOCUMENTS

| | | | | |
|---|---|---|---|---|
| 3,730,387 | A | 5/1973 | McConnell et al. | |
| 3,889,847 | A * | 6/1975 | Uroshevich et al. | 221/265 |
| 3,991,908 | A * | 11/1976 | Thomas et al. | 221/154 |
| 4,141,461 | A * | 2/1979 | LaChance | 220/253 |
| 4,322,017 | A * | 3/1982 | Lowdermilk | 222/43 |
| 4,613,057 | A * | 9/1986 | Sacchetti et al. | 221/265 |
| 5,123,574 | A * | 6/1992 | Poulos | 222/362 |

FOREIGN PATENT DOCUMENTS

| | | |
|---|---|---|
| FR | 2 396 697 | 2/1978 |
| FR | 2 745 554 | 9/1997 |
| WO | WO 95/05329 | 2/1995 |

* cited by examiner

*Primary Examiner*—Gene O. Crawford
*Assistant Examiner*—Michael K Collins
(74) *Attorney, Agent, or Firm*—Young & Thompson

(57) ABSTRACT

A pill dispensing cap for a bottle has an inner sleeve with a divider panel and a first base panel rotatable within an outer sleeve having a second base panel. First and second window openings are defined in the first and second base panels. A plate moveable across and within the two sleeves defines a third window opening and a fourth window opening is defined in the divider panel. The plate can be held in an initial position wherein the first and second windows are aligned, whilst the third and fourth windows are not aligned. The outer sleeve is rotatable to a condition wherein the first and second windows are not aligned and the plate can then be slid across to a condition wherein the third and fourth windows are aligned to allow pills in a bottle to enter the inner sleeve.

9 Claims, 2 Drawing Sheets

PILL DISPENSING DEVICE

There is a need for a device for attachment to a pill bottle to enable correct doses of pills to be determined by the user for dispensing at a required time. There are a number of such devices in existence, but the invention aims to provide such a device which is relatively easy to operate and is not complex in construction.

According to the present invention there is provided a pill dispensing cap for a bottle having inner and outer sleeves, the inner sleeve having an intermediate divider panel and a first base panel and the outer sleeve having a second base panel located immediately below the first base panel, first and second window openings defined in the first and second base panels, a plate moveable across and within the two sleeves and defining a third window opening, a fourth window opening defined in said divider panel, and a releasable locking arrangement whereby the plate can be held in an initial position wherein the first and second windows are aligned, whilst the third and fourth windows are not aligned, the outer sleeve being rotatable forwardly to a condition wherein the first and second windows are not aligned and the locking of the plate is released to enable the plate to be slid across to a condition wherein the third and fourth windows are aligned to allow pills in a bottle to enter the inner sleeve, replacement of the plate to its initial condition then allowing the outer sleeve to be rotated back to its initial condition, thus allowing pills to be dispensed from the inner container via the aligned first and second windows.

With this type of arrangement of a dispensing cap, pills can be released from a bottle into the inner sleeve when the plate has been slid across within the two sleeves to allow pills to be dispensed through the aligned third and fourth windows. The user can ensure that the correct number of pills are present within the dispensing cap before the plate is moved back to its initial condition, thus closing off the alignment of the third and fourth windows. The outer sleeve is then rotated to the initial condition to allow the pills to be dispensed to the user through the first and second windows.

The locking arrangement for holding the plate in the initial condition can be a notch in the plate into which the end of a groove in the outer container, receiving said plate, can be located.

Ideally, the plate will be spring loaded into the initial condition wherein part of the plate projects outwardly of the two sleeves, thus into a "fail safe" condition.

The plate desirably carries a boss limiting the extent of outward projection of the plate from the two sleeves.

The inner and outer sleeves may simply be interconnected by a snap-fit arrangement which allows for rotation of the outer sleeve.

Ideally, the cap will additionally enable the user to see how many doses have been dispensed, either by indicating the total number of doses or, for example, indicating the last day on which a dose was dispensed. Thus, the cap can include an indicator ring positioned between the two sleeves and movable upon rotation of the outer sleeve between separate ones of a series of temporary locating formations on the inner sleeve. In the preferred arrangement a ratchet leg is provided on the outer sleeve for cooperation with one of a series of ratchet teeth or grooves on the outer face of the indicator ring, designed to enable rotation of the indicator ring with the outer sleeve only in one direction of rotation of the outer sleeve. The indicator ring can carry notations of the number of doses of pills supplied by the cap through a viewing window.

The invention may be performed in various ways and a preferred example thereof will now be described, with reference to the accompanying diagrammatic drawings, in which.

Figure 3:
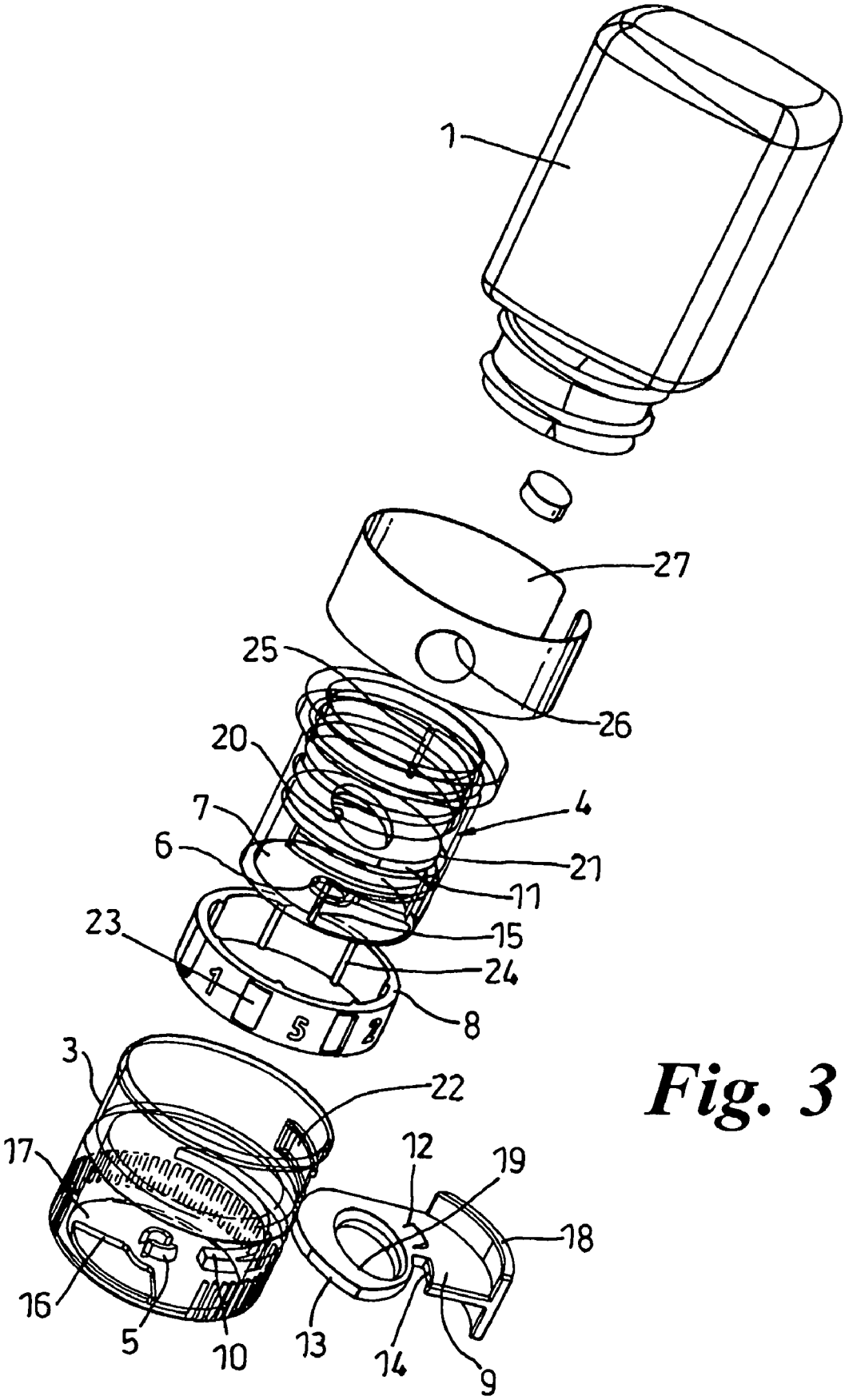
FIG. 3 is an exploded perspective view of the various parts of the pill dispensing cap of FIGS. 1 and 2.

As shown in the drawings, a standard pill bottle 1 has a pill dispensing cap 2 screwed onto the mouth of the bottle. If desired, this interconnection can incorporate a standard tamper proof interlocking arrangement which prevents inadvertent removal of the cap from the bottle. As can be seen more readily from FIG. 3, the cap incorporates an outer sleeve 3 and an inner sleeve 4, both of which are formed from a transparent plastics material. The sleeve 4 is secured within the sleeve 3 by a snap-fit location arrangement comprising a split spigot 5 locating into a locking hole 6 in the base panel 7 of the inner sleeve 4. Trapped between the inner and outer sleeves is an indicator ring 8. A plate 9 is slidably received through grooves 10 and 11 respectively formed in the sleeves 3 and 4. A snap-locating locking boss 12 limits the extent of removal of the plate from within the sleeves 3 and 4 and a biasing leaf spring 13 acts to push the plate outwardly to that limit.

Figure 1:
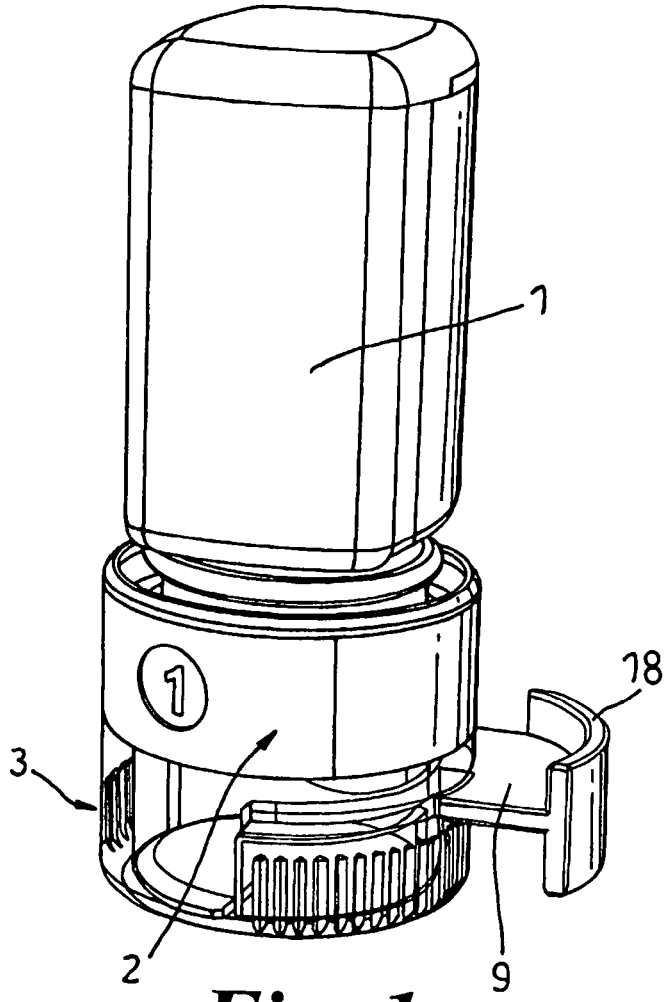
FIG. 1 is a side perspective view of a pill dispensing cap of this invention.
Figure 2:
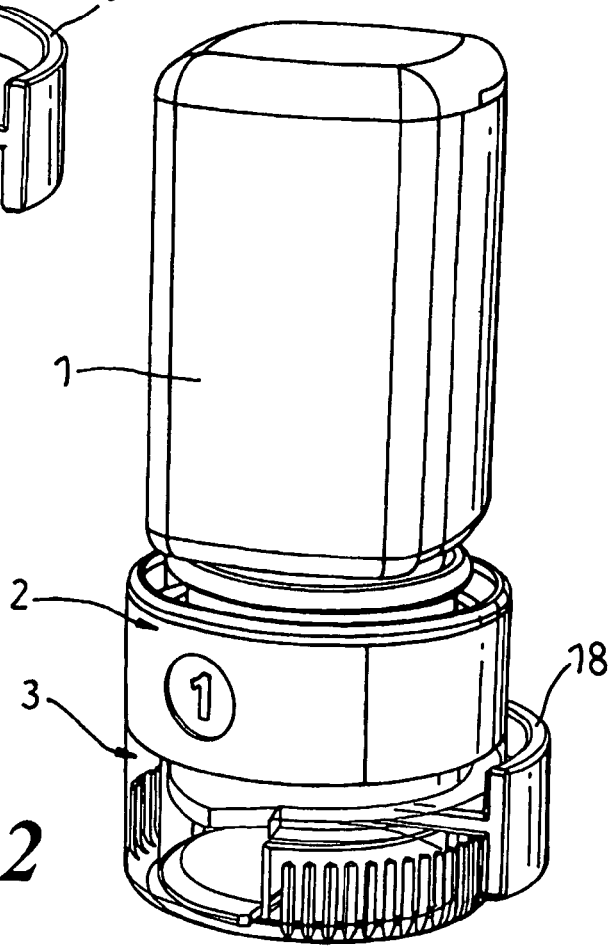
FIG. 2 is a view similar to FIG. 1, but during an initial stage of operation of the cap.

In a normal condition, as shown in FIG. 1, the plate 9 is in its outward condition and the outer sleeve 3 will have been rotated anti-clockwise to an extent whereby the end of the groove 11 will locate within a notch 14 of the plate 9. In this condition a first window 15 in the base panel 7 of the inner sleeve 4 is aligned with a second window 16 in a base panel 17 of the outer sleeve 3. The outer sleeve is then rotated clockwise so that the first and second windows 15 and 16 are no longer aligned and the interengagement of the groove 11 of the notch 14 is released. The plate 9 can now be pushed inwardly, by pressing on a finger plate 18, resulting in alignment of a third window 19 in the plate 9 with a fourth window 20 in a divider panel 21 within the inner sleeve 4. Pills within the bottle 1 can now be shaken out through the aligned windows 19 and 20 into the lower part of the inner sleeve 4. Once the user is satisfied that the correct number of pills are present within the inner sleeve 4, the plate 9 is released so that it moves outwardly under the bias of the spring 13 (and/or by pulling on the finger plate 18) so that the windows 19 and 20 are no longer aligned. The outer sleeve 3 is then rotated anti-clockwise back to the start position with the result that the windows 15 and 16 come into alignment. This allows the dose of pills to be released from the lower part of the inner sleeve 4 to the user.

When the outer sleeve 3 is initially rotated in a clockwise direction, a ratchet leg 22 is allowed to ride past ratchet grooves (or teeth) 23 on the indicator ring 8. However, when the outer sleeve 3 is rotated back in the anti-clockwise direction the ratchet leg 22 will engage with one of the ratchet grooves 23 and index round the indicator ring 8, overcoming engagement of locating ribs 24 with locating grooves 25 on the outer face of the inner sleeve 4. When the movement is completed, the locator ribs 24 will re-engage with the grooves 25, but with the indicator ring in the next position. The indicator ring 8 carries the numerals 1 to 7 in the sequence 1, 5, 2, 6, 3, 7, 4, which represent the number of doses or days of the week (letters for days of the week could equally well be employed). The indexing round of the indicator ring is such that the next number aligned with a viewing window 26 in a label 27 is two spaces on.

The invention claimed is:

1. A pill dispensing cap for a bottle having inner and outer sleeves, the inner sleeve (4) having an intermediate divider panel (21) and a first base panel (7) and the outer sleeve (3) having a second base panel (17) located immediately below the first base panel, first and second window openings (15,16) defined in the first and second base panels, a plate (9) moveable across and within the two sleeves and defining a third window opening (19), a fourth window opening (20) defined in said divider panel, and a releasable locking arrangement (14,11) whereby the plate can be held in an initial position wherein the first and second windows (15,16) are aligned, whilst the third and fourth windows (19,20) are not aligned, the outer sleeve (3) being rotatable forwardly to a position wherein the first and second windows are not aligned and the locking of the plate is released to enable the plate (9) to be slid across to a position wherein the third and fourth windows (19,20) are aligned to allow pills in a bottle to enter the inner sleeve (4), a return of the plate (9) to its initial position then allowing the outer sleeve (3) to be rotated back to its initial position, thus allowing pills to be dispensed from the inner sleeve (4) via the aligned first and second windows (15, 16).

2. A cap according to claim 1, wherein the locking arrangement is a notch (14) in the plate into which the end of a groove (11) in the outer container, receiving said plate, can be located.

3. A cap according to claim 2, wherein the inner and outer sleeves are interconnected by a snap-fit arrangement (24,25) which allows for rotation of the outer sleeve.

4. A cap according to claim 1, wherein the plate is spring loaded (13) into the initial position wherein part of the plate projects outwardly of the two sleeves.

5. A cap according to claim 4, wherein the plate carries a boss (12) limiting the extent of outward projection of the plate from the two sleeves.

6. A cap according to claim 1, including an indicator ring (8) positioned between the two sleeves and movable upon rotation of the outer sleeve between separate ones of a series of temporary locating formations (25) on the inner sleeve.

7. A cap according to claim 6, wherein a ratchet leg (22) is provided on the outer sleeve (3) for cooperation with one of a series of ratchet teeth or grooves (23) on the outer face of the indicator ring, designed to enable rotation of the indicator ring (8) with the outer sleeve only in one direction of rotation of the outer sleeve.

8. A cap according to claim 6, wherein the indicator ring carries notations of the number of doses of pills supplied by the cap through a viewing window.

9. A cap according to claim 7, wherein the indicator ring carries notations of the number of doses of pills supplied by the cap through a viewing window.

* * * * *